US007353551B2

(12) United States Patent
Racovolis

(10) Patent No.: US 7,353,551 B2
(45) Date of Patent: Apr. 8, 2008

(54) SUPPORT CUSHION

(75) Inventor: Glen Andrew Racovolis, Gowanbrae (AU)

(73) Assignee: Trimester Cushion Company, Gowanbrae (AU)

( * ) Notice: Subject to any disclaimer, the term of this patent is extended or adjusted under 35 U.S.C. 154(b) by 0 days.

(21) Appl. No.: 11/512,907

(22) Filed: Aug. 30, 2006

(65) Prior Publication Data

US 2008/0052832 A1 Mar. 6, 2008

(51) Int. Cl.
*A47C 16/00* (2006.01)
*A47G 9/10* (2006.01)

(52) U.S. Cl. ..... 5/632; 5/631; 5/930; 5/645

(58) Field of Classification Search ..... 5/630–632, 5/930, 735, 645, 639, 904
See application file for complete search history.

(56) References Cited

U.S. PATENT DOCUMENTS

| | | | | | |
|---|---|---|---|---|---|
| 2,562,725 | A * | 7/1951 | Leto et al. | 5/631 |
| 3,626,526 | A * | 12/1971 | Viel | 5/722 |
| 4,288,879 | A * | 9/1981 | Pate | 5/631 |
| D266,549 | S * | 10/1982 | Lund, III | D6/601 |
| 4,397,052 | A * | 8/1983 | Lund, III | 5/631 |
| 4,506,396 | A * | 3/1985 | Ritchie et al. | 5/631 |
| 4,584,730 | A * | 4/1986 | Rajan | 5/632 |
| 5,182,828 | A * | 2/1993 | Alivizatos | 5/631 |
| 5,357,642 | A * | 10/1994 | Clute | 5/655 |
| 5,471,691 | A * | 12/1995 | Ryndak | 5/645 |
| 5,661,862 | A * | 9/1997 | Ryndak | 5/636 |
| 5,664,271 | A * | 9/1997 | Bellavance | 5/632 |
| 5,978,990 | A * | 11/1999 | Akey | 5/632 |
| 6,886,201 | B1 * | 5/2005 | Weiss-Lohrei | 5/631 |
| 7,055,196 | B2 * | 6/2006 | Littlehorn | 5/631 |
| D547,586 | S * | 7/2007 | Weiss-Lohrei | D6/601 |
| 2006/0042012 | A1 * | 3/2006 | Littlehorn | 5/632 |

FOREIGN PATENT DOCUMENTS

AU 2005-202013 5/2005

OTHER PUBLICATIONS

The Boppy Company, "The Cuddle Pillow", pp. 1-2, printed at http://store.babycenter.com/product/maternity/maternity+pillows/the+cuddle+pillow on Mar. 20, 2007.
The Boppy Company, "The Pregnancy Wedge", pp. 1-2, printed at http://store.babycenter.com/product/maternity/maternity+pillows/the+pregnancy+wedge on Mar. 20, 2007.
Snoozer Body Pillows, "Snoozer Pillow", pp. 1-2, printed at http://store.babycenter.com/product/maternity/maternity+pillows/snoozer+pillow on Mar. 20, 2007.
Leachco, "Grow to Sleep Adjustable Body Pillow", pp. 1-2, printed at http://store.babycenter.com/product/maternity/maternity+pillows/grow+to+sleep+adjustable+body+pillow on Mar. 20, 2007.
Leachco, "Back 'N Belly Contoured Pillow", pp. 1-3, printed at http://store.babycenter.com/product/maternity/maternity+pillows/back+n+belly+contoured+pillow on Mar. 20, 2007.

* cited by examiner

*Primary Examiner*—Robert G. Santos
(74) *Attorney, Agent, or Firm*—Wolf, Greenfield & Sacks, PC

(57) ABSTRACT

A cushion for use by a person, the cushion having a main portion and a subsidiary portion joined to the main portion. The main portion and the subsidiary portion have unequal volumes wherein a part of the main portion is adapted to be placed between the legs of the person while the person is lying on a side of the person, and the subsidiary portion is adapted to support the abdomen of the person while the person is lying on the person's side.

13 Claims, 3 Drawing Sheets

(a)

(b)

SUPPORT CUSHION

FIELD OF THE INVENTION

This invention relates to a support cushion, and more particularly relates to a support cushion for use by pregnant women, when resting or lying on one side, or for use by overweight people.

BACKGROUND

Pregnant women often find it difficult to rest or lie down comfortably, particularly in the latter stages of the second trimester and the last trimester of the pregnancy. This difficulty is due to the abdomen moving to the lowermost side of the pregnant women's body under the influence of gravity when she is lying on her side or turning onto her side. In other words, rather than being located centrally in line with a central axis of her body, such as along the spine, the weight of the abdomen forces it into a lower position, resulting in uneven weight distribution. This uneven distribution can lead to health problems, particularly in relation to the back and spine. The weight transfer and uneven weight distribution adds stress on the back and can cause back ache and muscular ache. Under these conditions, a pregnant woman often can not get adequate rest. Similar problems arise in overweight people who have enlarged abdomens; lying on a side or turning to be on their side can lead to back and spinal injuries or aches.

SUMMARY

Aspects of the present invention seek to overcome these disadvantages by providing a cushion that substantially prevents the uneven weight distribution created by an enlarged abdomen. In some aspects, such a cushion assists a person in improving lying posture and/or enables a person to obtain adequate rest.

According to an aspect of the invention, there is provided a cushion for use by a person comprising a main portion and a subsidiary portion joined to the main portion. The main and the subsidiary portions have different volumes, and a part of the main portion is adapted to be placed between the legs of the person while the person is lying on their side. The subsidiary portion is adapted to support the abdomen of the person while the person is lying on their side.

A depression may be formed in a region in the vicinity of the joining of the main and subsidiary portions of the cushion, for example, (at least in part) due to unequal volumes of each portion. This depression may aid in creating a space for the abdomen of a person. Further, the height of the subsidiary portion may be less than the height of the main portion, further aiding in creating a space for the abdomen. As used herein, a "joining region" is a region in the vicinity of the joining (i.e., the junction, intersection or seam) of the main and subsidiary portions of the cushion. This vicinity includes the location of the joining itself.

The joining between the main and subsidiary portions preferably extends from one location of the exterior of the main portion to another location of the exterior of the main portion, with the main and subsidiary portions sharing an exterior outline of the cushion between the exterior locations of the main portion.

The cushion and the joining may be curved, and a part of the main portion that may be placed between the legs of a woman may have greater bulk or volume than the remainder of the main portion of the cushion.

The interior of the cushion may be formed as layers of material. In some embodiment, more layers may be incorporated or shaped to provide filling for both the main and subsidiary portions than for just the main portion alone. For example, one or more first layers of material may extend between both the main and subsidiary portions of the cushion, whereas one or more second layers may be interspersed between the first layers, and may extend to only the limits of the main portion. Further manipulations may be performed on these layers, including forming a cover over the layers, to form the cushion. As a result, the subsidiary portion of the cushion may be comprised of a lesser amount of material than the main portion and may consume a less volume than the main portion.

Each of the main and subsidiary portions may have fastening means for removing and inserting the cushion material to enable the amount of cushion material and placement of cushion material to vary (e.g., if the material is not comprised of sheets or layers). Such an arrangement enables a cover (e.g., a loose cover) for the cushion to be washed regularly. The fastening means may be any of a variety of types of fastening means such as, for example, Velcro®, buttons or a zipper mechanism.

The material used to make the bulk of the cushion may be in the form of layers, as previously mentioned, and such layers may be made from suitable foam, sponge other soft material or any suitable combination of the foregoing. If the volume of each of the main and subsidiary portions is created from filling material, that is, filling placed directly into the subsidiary portion and into the main portion, such filling material may be made of any of a variety of types of suitable materials such as, for example, sponge, foam, feathers, polystyrene ball materials, another suitable material, or any suitable combination of the foregoing.

Other advantages, novel features, and objects of the invention, and aspects and embodiments thereof, will become apparent from the following detailed description of the invention, including aspects and embodiments thereof, when considered in conjunction with the accompanying drawings, which are schematic and which are not intended to be drawn to scale. In the figures, each identical or nearly identical component that is illustrated in various figures is represented by a single numeral. For purposes of clarity, not every component is labeled in every figure, nor is every component of each embodiment or aspect of the invention shown where illustration is not necessary to allow those of ordinary skill in the art to understand the invention.

DETAILED DESCRIPTION

Although embodiments described herein are described primarily in relation to a cushion adapted for use by a pregnant women, the invention is not so limited. It should be appreciated that embodiments of the invention may be used and/or configured for use by overweight persons or any other type of person having an enlarged abdomen.

Figure 1:
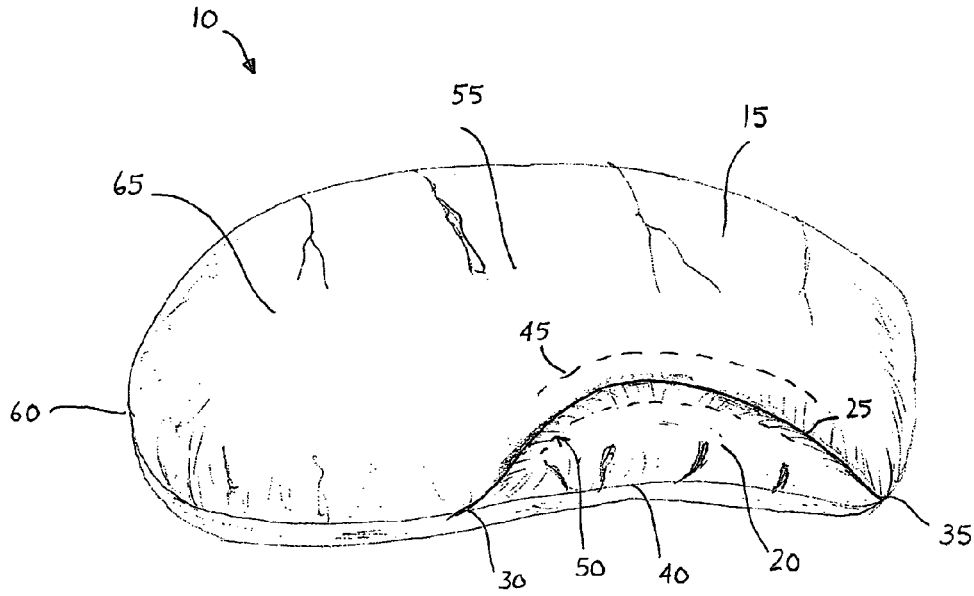
FIG. 1 is a perspective view from above of a cushion, according to an embodiment of the invention.
Figure 2:
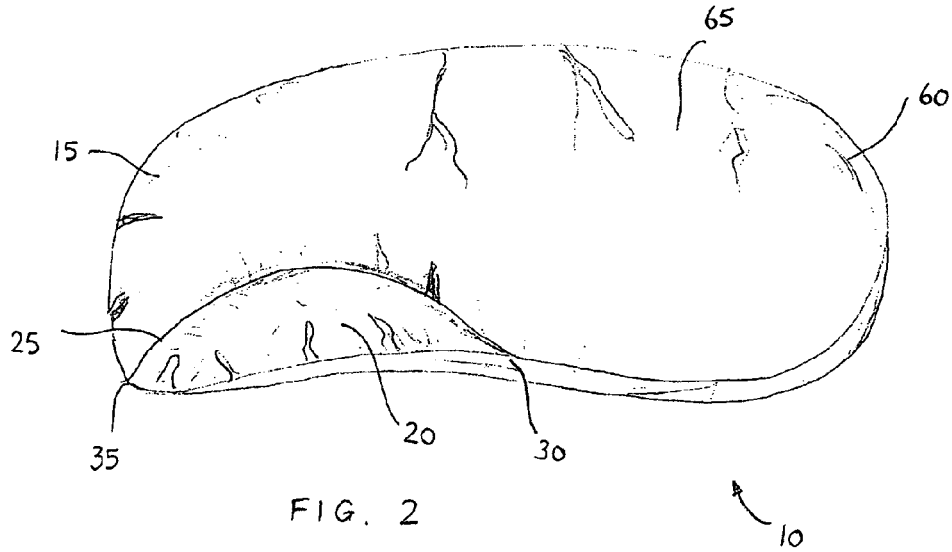
FIG. 2 is a reverse perspective view, compared to FIG. 1 of the cushion, according to an embodiment of the invention.
Figure 3:
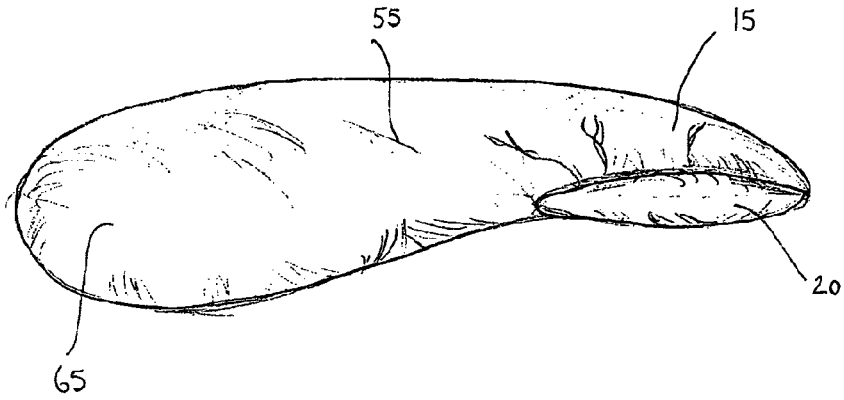
FIG. 3 is a side view of the cushion of FIGS. 1 and 2, according to an embodiment of the invention.

With reference to FIGS. 1 and 2, there is shown perspective views of a cushion that is adapted to be used by a pregnant woman, particularly in the latter stages of the second trimester and in the third trimester of pregnancy. It is to be noted that the following description is equally applicable to overweight people or other people who have enlarged abdomens. The cushion 10 comprises a main portion 15 and a subsidiary portion 20, with the subsidiary portion 20 affixed to the main portion 15 at joining 25. The joining 25 is generally curved and extends from a first exterior point 30 of the main portion 15 to a second exterior point 35 of the exterior of main portion 15. This means that both of the portions 15 and 20 share a common exterior portion or joining 40.

When each of the portions 15 and 20 are filled with cushion material, such as, for example, feathers, foam, sponge, other material or suitable combination of the foregoing, it creates a depression around the join 25 such that there is a raised portion extending along the line 45 of main portion 15 and also along the line 50 of the subsidiary portion 20. The depression so formed along the join 25 assists in providing a space for the abdomen of the pregnant woman. In some embodiments, the height of the filler material in portion 20 is less than the height created by the filler material in portion 15. Access for the filler material in each of the portions 15 and 20 may be through suitable fastening means, such as, for example, buttons, zip fastener, Velcro®, another fastening means, or a suitable combination of the foregoing. The fastening means may be used to assist in rearranging the filler material within each portion, and controlling the amount of filler material in each portion. This fastening means may be part of a cover (e.g., a loose-fitting cover), which can be separately washed repeatedly when needed.

In some embodiments, a greater bulk of filler material may be located at one end (e.g., 60) of main portion 15, or between a middle portion 55 and end 60, such as in region 65, of the main portion 15. Such an end or region may correspond to a position where the legs of a pregnant woman will straddle the cushion 10 when in a lying position.

Figure 5:
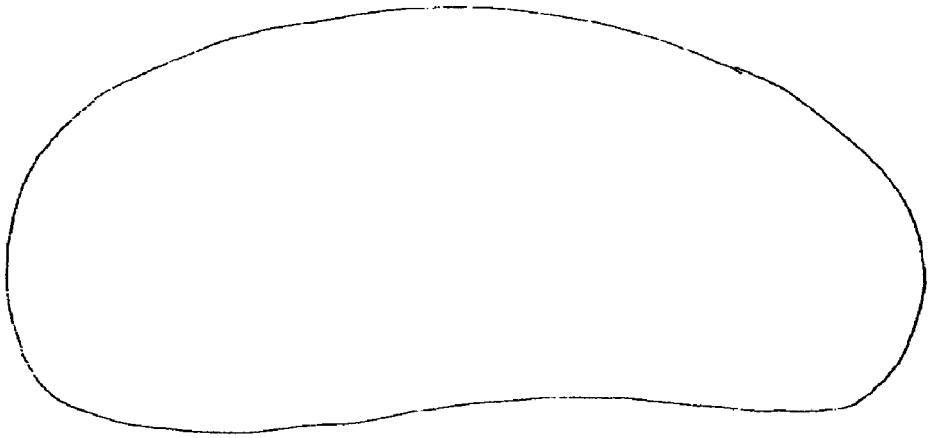
FIG. 5 is a plan view showing two different layers of filler material for forming a cushion, according to an embodiment of the invention.
Figure 5:
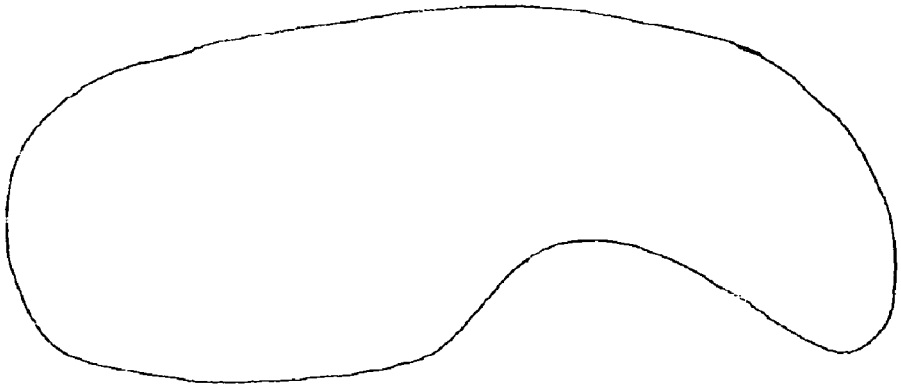

In some embodiments, each of the portions 15 and 20 may be formed through a series of layers of filling material, such as foam or sponge (see FIG. 5). In order to create the subsidiary portion shape, a number of such layers may extend to both the main portion and the subsidiary portion. These shared layers may be interspersed with alternating layers that extend only to the main portion, not the subsidiary portion. All of the layers then may be compressed, covered and then stitched (or otherwise joined) along the boundary between the main and subsidiary portions. This stitching or other boundary divider thus may form joining 25, defining the shape of the subsidiary portion and the main portion.

Figure 4:
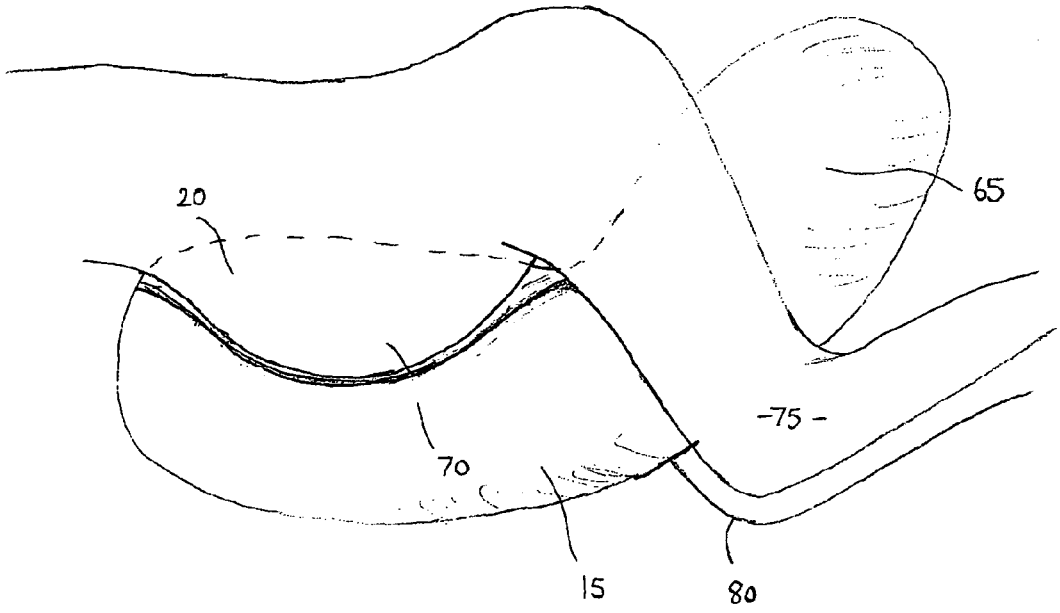
FIG. 4 is a view from above showing the lying position of a pregnant woman when using the cushion, according to an embodiment of the invention.

The cushion 10 may enable a pregnant woman to lie comfortably on either side with the portion 65 of main portion 15 tucked between her legs. This position is more clearly seen in FIG. 4, which shows a plan view with the woman lying on her side and the enlarged abdomen 70 located on subsidiary portion 20. The portion 65 of main portion 15 is placed between the woman's legs 75 and 80. The bulk material in portion 65 between the woman's legs 75 and 80 may provide additional stability in the lying position. To change sides, a person can roll onto the person's back and utilise the reverse side of the subsidiary portion. Using the cushion in this manner should provide an improved posture for the person. That is, it should enable a person to lay in the side-lying position while keeping the weight of the abdomen essentially in line with a central axis of the person's torso, e.g., the spine. FIG. 5 is a side view showing the cushion in use with abdomen 70 supported by portion 20.

As noted above, the cushion filling material may be any of a variety of suitable materials, including, but not limited to: suitable feathers; down; polystyrene balls (as in bean bags); foam; sponge material; another suitable material; or any suitable combination of the foregoing. The cushion may be constructed and arranged so that the amounts of filling material in different portions of the cushion (e.g., 15 and 20) can vary and can be readjusted A cover, made of suitable material such as cotton, may be capable of enclosing the cushion material, and may be removable and perhaps loose-fitting to enable regular washing of the cover.

In some embodiments, a speaker and lead may be incorporated into the cushion having an attachment to an audio playing device, such as an MP3 player, radio etc. The speaker may be placed adjacent the subsidiary portion to enable music to be heard by a fetus in situations where a pregnant woman has her abdomen supported by the subsidiary portion.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A cushion for use by a person comprising:

a main portion; and a subsidiary portion joined to the main portion, wherein the main portion and the subsidiary portion are of unequal volume, and a part of the main portion is adapted to be placed between the legs of the person while the person is lying on a side of the person, and wherein the subsidiary portion is adapted to support the abdomen of the person while the person is lying on the side;

wherein the interior of the cushion comprises layers of material;

wherein there are more layers of material shaped to provide filling for both the main and subsidiary portions than there are layers shaped to provide filling for the main portion only so that the main portion has a greater thickness than the subsidiary portion; and wherein the cushion comprises a depression formed at a joining region proximate to a joining of the main portion and the subsidiary portion, the depression serving as at least part of a space for supporting the abdomen of the person.

2. A cushion according to claim 1, wherein the joining between the main portion and the subsidiary portion extends from one location of the exterior of the main portion to another location of the exterior of the main portion, and wherein the main portion and the subsidiary portion share an exterior outline of the cushion between the two exterior locations, between which extends the joining.

3. A cushion according to claim 2, wherein the cushion and the joining are curved and the part of the main portion to be placed between the legs of the person has greater volume than the remainder of the main portion of the cushion.

4. A cushion according to claim 1, further comprising fastening means incorporated into the main portion and the subsidiary portion, the fastening means enabling removing and inserting cushion material so that the amount of cushion material and placement of the cushion material can vary.

5. A cushion according to claim 1, further comprising means for attachment to an audio playing device to enable audio to be emitted from the speaker means while the cushion is being used by the person.

6. A cushion for providing support for an abdomen of a person lying on a side of the person, comprising:

a main portion having a first minimum height and a generally oblong shape, the main portion having at least a first and a second integral parts containing filling material; and a subsidiary portion having a second height less than the first minimum height and a generally semi-circular shape, the subsidiary portion having a perimeter with a curved portion, the curved portion forming a boundary between the first part of the main portion and the subsidiary portion, wherein:

a difference between the first and second height, the shape of the subsidiary portion and a curvature of the boundary are configured and arranged to accommodate and support an abdomen of a person lying on a side of the person;

the first part is disposed on a first side of the subsidiary portion and the second part extends beyond the subsidiary portion on a second, opposite side; and a depression is formed along the boundary between the first part of the main portion and the subsidiary portion.

7. The cushion of claim 6, wherein the second part of the main portion is configured to be placed between legs of the person while the person is lying on a side of the person.

8. The cushion of claim 7, wherein the at least a part of the main portion has a third height greater than the first minimum height, and wherein: a height of the at least a part of the main cushion relative to the first minimum height of the main cushion; the shape of the main portion; and a location of the at least part of the main portion relative to the subsidiary portion, are configured for placement of the second part of the main portion between the legs of the person while the person is lying on a side of the person with an abdomen of the person supported by the subsidiary portion.

9. A cushion for use by a person, the cushion comprising:

a main portion having an inner, generally concave edge and an outer, generally convex edge, the main portion comprising at least a first part and a second part; and a subsidiary portion, the subsidiary portion having an outer generally curved edge conforming to the inner, generally concave edge of the main portion adjacent the first part, wherein the main portion and the subsidiary portion are adapted and configured to position the subsidiary portion to support an enlarged abdomen of a person straddling the cushion with the second part between legs of the person, wherein the cushion comprises a depression formed by a boundary between the first part of the main portion and the subsidiary portion.

10. The cushion of claim 9, wherein the main portion has a first end and a second end, the second part being disposed at the second end, the second end being broader than the first end.

11. The cushion of claim 10, wherein the main portion has a first thickness and the subsidiary portion has a second thickness, less than the first thickness.

12. The cushion of claim 11, further comprising a covering with a fastener adapted and configured to allow filling material of the subsidiary portion to be added or removed to change the bulk of the filling material in the subsidiary portion.

13. The cushion of claim 11, wherein the second part is adapted and configured to extend from an anterior side of the person, between the legs of the person to beyond a posterior side of the person when the person straddles the cushion.

* * * * *